US008814560B2

(12) United States Patent
Le Mer et al.

(10) Patent No.: US 8,814,560 B2
(45) Date of Patent: Aug. 26, 2014

(54) DEVICE AND METHOD FOR STABILIZING THE PRESSURE AND THE FLOW OF A GASEOUS MIXTURE SUPPLIED TO A SURFACE-COMBUSTION CYLINDRICAL BURNER

(75) Inventors: Joseph Le Mer, Plouezoch (FR); Rocco Giannoni, Milan (IT)

(73) Assignee: Giannoni France (FR)

( * ) Notice: Subject to any disclaimer, the term of this patent is extended or adjusted under 35 U.S.C. 154(b) by 524 days.

(21) Appl. No.: 12/809,289

(22) PCT Filed: Dec. 3, 2008

(86) PCT No.: PCT/EP2008/066732

§ 371 (c)(1),
(2), (4) Date: Jun. 18, 2010

(87) PCT Pub. No.: WO2009/077333

PCT Pub. Date: Jun. 25, 2009

(65) Prior Publication Data

US 2010/0316965 A1 Dec. 16, 2010

(30) Foreign Application Priority Data

Dec. 19, 2007 (FR) ..... 07 59967

(51) Int. Cl.
*F23N 1/02* (2006.01)
*F23D 3/40* (2006.01)
*F23D 14/12* (2006.01)

(52) U.S. Cl.
USPC ..... 431/12; 431/326; 431/328

(58) Field of Classification Search
USPC ..... 431/12, 10, 9, 116, 183, 168, 8, 173, 431/177, 182, 122, 326–329, 350–352; 126/110 B, 91 R, 91 A; 237/12; 60/748; 110/231; 123/306; 239/34, 461, 399, 239/403, 405, 463
See application file for complete search history.

(56) References Cited

U.S. PATENT DOCUMENTS 2,669,297 A * 2/1954 Sherman ..... 431/9
3,975,141 A * 8/1976 Sweet ..... 431/352
(Continued)

FOREIGN PATENT DOCUMENTS

DE 4004778 A1 8/1990
DE 9013114 U1 12/1990
(Continued)

OTHER PUBLICATIONS

International Search Report, PCT/EP2008/066732, dated Feb. 10, 2009.

*Primary Examiner* — Avinash Savani
*Assistant Examiner* — Vivek Shirsat
(74) *Attorney, Agent, or Firm* — Lerner, David, Littenberg, Krumholz & Mentlik, LLP

(57) ABSTRACT

The invention relates to a gas burner comprising a perforated cylindrical wall used as a combustion surface, a bottom wall and an inlet opening through which a combustible gaseous mixture is fed inside the burner. The stabilisation device consists of a grid (4*a*) that can be positioned in the inlet opening of the burner, and that comprises a central ring (5*a*) surrounded by a series of diverting vanes (6), the grid being thus configured so as to allow the free passage of the central portion of the flow of gaseous mixture entering the burner through the central ring (5*a*) while said diverting vanes (6) generate an eddy movement in the peripheral portion of the flow entering the burner from the outside of the central ring (5*a*).

13 Claims, 6 Drawing Sheets

(56) References Cited

U.S. PATENT DOCUMENTS

| | | | | |
|---|---|---|---|---|
| 4,141,213 | A * | 2/1979 | Ross | 60/39.821 |
| 5,197,871 | A * | 3/1993 | Yamamoto et al. | 431/262 |
| 5,758,587 | A * | 6/1998 | Buchner et al. | 110/260 |
| 5,879,148 | A * | 3/1999 | Cheng et al. | 431/9 |
| 6,162,049 | A * | 12/2000 | Pellizzari et al. | 431/326 |
| 6,993,916 | B2 * | 2/2006 | Johnson et al. | 60/776 |
| 2005/0098147 | A1 * | 5/2005 | Chen | 123/306 |
| 2007/0207426 | A1 * | 9/2007 | Perry et al. | 431/183 |

FOREIGN PATENT DOCUMENTS

| | | | |
|---|---|---|---|
| EP | 1538395 | A1 | 6/2005 |
| EP | 1813882 | A1 | 8/2007 |
| FR | 2476808 | A1 | 8/1981 |
| FR | 2843189 | A1 | 2/2004 |
| GB | 2070211 | A | 9/1981 |
| WO | 9416272 | A1 | 7/1994 |
| WO | 2006053542 | A1 | 5/2006 |

* cited by examiner

DEVICE AND METHOD FOR STABILIZING THE PRESSURE AND THE FLOW OF A GASEOUS MIXTURE SUPPLIED TO A SURFACE-COMBUSTION CYLINDRICAL BURNER

CROSS REFERENCE TO RELATED APPLICATIONS

The present application is a national phase entry under 35 U.S.C. §371 of International Application No. PCTEP2008/066732, filed Dec. 3, 2008, published in French, which claims the benefit of French Patent Application No. 07 59967, filed Dec. 19, 2007. The disclosures of said applications are incorporated by reference herein.

The present invention relates to supplying a combustible gaseous mixture, for example an air/natural gas, air/propane, air/butane, air/biogas or air/vaporized fuel mixture, to a surface combustion cylindrical burner.

More specifically, its object is a device for stabilizing pressure and flow rate for such a gas burner, a gas burner equipped with this stabilizing device, as well as a method for stabilizing the pressure and the flow rate of the gaseous mixture supplied to the burner.

A cylindrical gas burner with surface combustion includes a cylindrical perforated wall, pierced with a multitude of small orifices, a discoidal bottom wall and an inlet opening, through which a combustible gaseous mixture formed beforehand (pre-mixed) is introduced inside the burner, for example by means of a fan or a turbine.

Usually, the cylindrical wall is a perforated stainless steel metal sheet, the orifices being circular holes and/or slots with a very small section.

However, the invention also applies to walls, either grid-shaped or shaped as a porous material layer resisting to high temperatures (for example woven fibers in a refractory material).

The combustible gas is distributed inside the burner and rapidly escapes through the orifices of the cylindrical wall, the burner having been ignited, the external face of the wall acts as a combustion surface, each orifice generating a radial flame of more or less great height, depending on the area of its section and on the gas flow rate.

This kind of burner is notably adapted for equipping a boiler for domestic or industrial use, provided with one or more tubes (of circular or other section) surrounding the combustion surface.

One or more fluids to be heated up flow in this (these) tube (s) which is (are) licked by the burning gases from the combustion surface.

Different configurations are possible, in particular comprising a sheet of rectilinear tubes parallel to the generatrices of the burner (see for example document FR-A-2 476 808), or comprising one or more bundles of helically wound tubes (see for example documents WO 94/16272, FIG. 18 or EO-A-1 813 882).

More particularly, the invention relates to the stabilization of the pressure and flow rate of the gaseous mixture inside the burner, so as to obtain complete and homogenously distributed combustion over the whole cylindrical combustion surface of the burner, with a uniform flame height, with which it is possible to obtain an optimum yield while reducing the emissions of carbon monoxide (CO) and of carbon dioxide ($CO_2$).

The quality and hygiene of the surface combustion obtained by this type of burner depends on several parameters, in particular on the size (passage section) of the orifices made in the cylindrical wall, and on their mutual spacing (punching ratio of the perforated wall).

Depending on the length and on the diameter of the cylindrical element, it is difficult to ensure regular gas flow rate over the whole length of the burner.

Now, the uniformity of the gas flow rate over the whole of the combustion surface conditions the combustion height. and its regularity over the whole of this surface, on which depends the emission of CO and of $CO_2$.

With the purpose of improving this uniformity, it has already been proposed to line the cylindrical wall by interiorly providing the burner with an also cylindrical envelope (second wall), also perforated with a diameter slightly smaller than that of the wall which acts as a combustion surface, both of these walls being coaxial. This arrangement has the effect of increasing the pressure level required for the escape of the gaseous mixture, the latter should in a first phase cross the orifices of the internal casing in order to occupy the annular space located between both walls and then the orifices of the external wall which acts as a combustion surface. Thus, the combustion orifices are fed with a relatively regular pressure over the whole surface of the external wall.

This solution is not fully satisfactory insofar that the obtained uniformity is riot perfect and because the adjunction of the internal envelope substantially increases the weight and the cost price of the burner. Further, the presence of the internal envelope induces a significant pressure loss of the gas flow circulating in the burner.

Proper distribution of the gas premix inside the burner is largely related to the flowing of the gas flow just before it enters the burner, as we shall now explain this with reference to FIGS. 1-3.

In these figures, a surface combustion gas burner of a traditional type is illustrated, comprising a cylindrical perforated wall 2, with an X-X' axis (for example horizontal), crossed by a multitude of small orifices 20, a sealed discoidal bottom 3 and a circular inlet opening 10, through which a combustible gas mixture is introduced inside the burner 1.

This is a mixture made beforehand of a fuel with an oxidizer, notably of liquefied petroleum gas, of natural gas, of biogas (from fermentation), or even of vaporized fuel oil, mixed with air or oxygen, in an adequate proportion so as to ensure proper and complete combustion.

In a well-known way, this combustible premix designated as G, is provided to the burner by means of a fan V.

The combustion surface is formed by the external face of the wall 2, on which the flames are formed, referenced as F.

Combustion is generally initiated by an igniter (not shown) located in proximity to this surface).

In order to improve the distribution of pressure inside the burner 1 and correlatively, the quality of the combustion, the insertion of a sleeve between the outlet of the fan V and the inlet 10 of the burner is known.

In the configuration illustrated in FIG. 1, the outlet mouth of the fan is circular and has the same diameter as the inlet 10 of the burner. The sleeve M used is cylindrical also with this diameter and the whole is coaxially mounted along X-X'.

Thus, the gas flow, symbolized by the arrows f is regular, and the burner 1 is homogenously fed, by which it is possible to obtain a good distribution of the pressures and flow rates in the burner, expressed by a relatively constant flame height h over the whole combustion surface.

On many boiler versions, it is not possible, notably for reasons of bulkiness, to place the fan in the axis of the burner.

This is the case for the configuration illustrated in FIG. 2, in which the axis of the fan is shifted relatively to the latter. The connecting sleeve M' here has end portions bent at right angles, so that the gas flow G penetrating the burner has a deviated and perturbed trajectory, generating an irregular flame height F'.

In the configuration illustrated in FIG. 3, the connecting sleeve M" is provided with a safety valve comprising a flap A, jointed in the upper portion, the function of which is to prevent returns of burnt gases from the burner towards the fan, when the latter is at a standstill. This is in particular useful when several apparatuses are connected to a same chimney.

The valve is closed when the flap under the effect of the own weight, is in the vertical position $A_0$ illustrated in dashed lines in the figure.

Its opening angle is automatically a function of the operating conditions, the gas flow provided by the fan opposing the weight of the flap A in a more or less significant way depending on the flow rate.

The flow f" passing under the flap in order to then enter the burner, is also diverted here at an angle) and perturbed, generating an irregular flame he F".

In many configurations and operating modes of boilers, notably with operating conditions with variable flow rate allowing modulation of power, it is delicate to obtain homogenous distribution of the flame heights on the combustion surface.

The difficulty is further increased in the case of offset positioning of the fan relatively to the burner (FIG. 2) or in the case of the presence of a flap at the input of the burner (FIG. 3).

The object of the invention is to solve these problems, by proposing a pressure and flow rate stabilizing device of simple design, without any moving parts, lightweight and not very costly, practically inducing no pressure loss, adapted so as to be placed at the inlet of the burner in order to notably improve the distribution of the gas mixture inside the burner and to thereby ensure homogenous feeding of the whole of the orifices of the combustion surface, by generating a constant flame height over the whole of this surface.

As already stated, this pressure and flow rate stabilizing device is intended to equip a gas burner including a perforated cylindrical wall acting a combustion surface, a bottom wall and an inlet opening, through which a combustible gas mixture is introduced inside the burner.

According to the invention, the device consists in a grid adapted so as to be positioned inside said inlet opening and including a central ring surrounded by a series of diverting vanes, this grid being thereby conformed so that it allows free passage of the central portion of the gas mixture flow penetrating the burner through the central ring, while said diverting vanes generate a vortex movement of the peripheral portion of this flow penetrating the burner from the outside of the central ring.

Thus, the burner is simultaneously fed with two gas flows of different configurations, i.e. an outer cyclonic vortex which moves following an approximately helical path towards the bottom wall of the burner and a non-perturbed or slightly perturbed central flow which also moves towards the bottom of the burner while expanding inside the cyclone.

Rather surprisingly, such an arrangement ensures a regular pressure over the whole surface of the burner, both along its circumference and along its length.

The object of patent document EP-1 538 395 is a cylindrical gas burner interiorly provided with a device intended for reducing acoustic resonance phenomena and correlatively noises of the burner.

This device comprises parallel or "cross-shaped" partitions which prevent any vortex movement of the gas mixture feeding the burner, which acts against homogenization and proper distribution of this mixture, contrary to the sought goal.

The German utility model DE 9013114 U, as for it, describes a disk intended to equip a fuel oil or gas burner. This disk is provided with a central opening crossed by the combustible material (fuel) and by a first portion of the air (oxidizer), as well as with a series of radial slots which are crossed by the other portion of the air required for the combustion. This document does not specify with which burner shape this disk is associated, nor a fortiori that the disk is positioned inside the inlet opening of this burner.

Its function is not to improve the distribution of a gas premix already formed, inside the burner, but rather to enhance this premixing from two flows of different natures, i.e. a central flow formed with fuel and air and a peripheral flow only formed with air.

It is not excluded that said mixture feeds the burner via a doubly bent sleeve such as the one designated by M' in FIG. 2, or via a sleeve provided with a safety valve such as the one designated as M" in FIG. 3 of the present patent application, with the drawbacks resulting therefrom as this is discussed above.

According to other possible advantageous, but non-limiting features of the invention:

- the central ring is circular and is coaxial With the perforated cylindrical wall (when the device is mounted on the burner);
- said vanes extend radially relatively to the axis of the perforated cylindrical wall (when the device is mounted on the burner) with a regular angular distribution;
- the number of vanes is comprised between 6 and 30 and advantageously between 11 and 25;
- said vanes are planar lamellas, all identical and with constant width, which are tilted in the longitudinal direction, their plane forming an acute angle relatively to the axis of the perforated cylindrical wall;
- said angle has a value comprised between 15 and 45°, preferably of the order of 30°;
- said vanes are integral with the central ring;
- said grid comprises an outer circular ring, the vanes of which are integral with it, capable of being fitted and immobilized in the inlet opening of the burner;
- the central ring is a sleeve, the length of which is substantially equal to the axial dimension of the vanes (suitable solution for a burner of small or medium length);
- the central ring is a sleeve, the length of which is greater than the axial dimension of the vanes (suitable solution for a burner of great length).

The object of the invention is also a surface combustion cylindrical burner equipped with a pressure stabilizing device as described above.

Finally, its object is also a method for stabilizing the pressure and flow rate of a combustible gas mixture feeding a gas burner, the latter including an inlet opening, a perforated cylindrical wall acting as a combustion surface, and a bottom wall, this method consisting of dividing the gas mixture penetrating the burner into two distinct flows, i.e. a central flow with a non-perturbed or not very perturbed, substantially laminar flow, capable of reaching said bottom wall while flaring out gradually, and a vortex flow with an approximately helical trajectory surrounding the central flow.

Other features and advantages of the invention will become apparent upon reading the following description of a preferred embodiment of the invention.

This description is made with reference to the appended drawings wherein.

Figure 4:
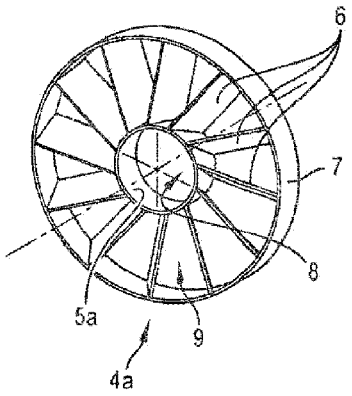
FIG. 4 is a perspective view of a first possible embodiment of the stabilizing device of the invention.
Figure 5:
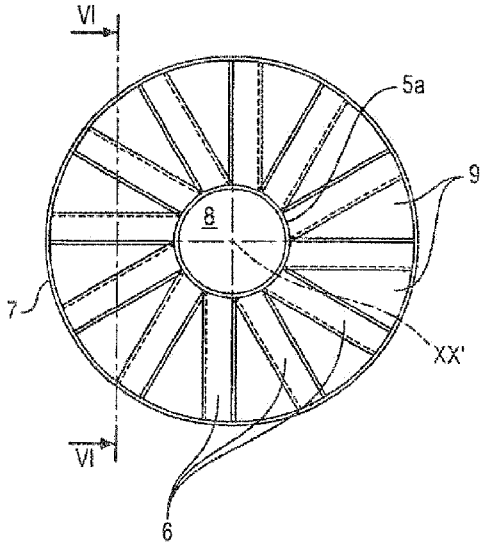
FIG. 5 is a front view at a larger scale of the device of FIG. 4.
Figure 6:
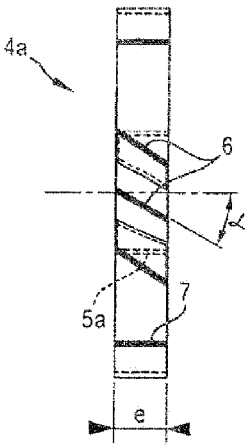
FIG. 6 is a side sectional view of the same device, the sectional plane being referenced as VI-VI in FIG. 5.

The device illustrated in FIGS. 4-6 consists in a grid, for example a stainless steel metal sheet of small thickness.

This grid 4*a* consists of a pair of concentric rings, one being central 5*a*, the other external 7, in the form of cylindrical sleeves of small length, with a common axis X-X', as well as a series of vanes 6.

The latter extend radially with respect to the X-X' axis with a regular angular distribution.

In the illustrated example, the grid includes 12 vanes, distributed at 30° from each other around the central ring.

They are attached at their ends, for example by welding, to each of the two sleeves 5*a* and 7.

As this is may be observed in FIG. 6, both sleeves and the vanes are of small thickness and their axial dimension e is identical.

The outer diameter of the ring 7 is selected so as to correspond to the inner diameter of the cylindrical wall of the burner to be equipped, so that the grid may be inserted and maintained without any play (clearance) in the inlet opening of the burner, coaxially with the latter.

These vanes 6, all identical, are planar lamellas with constant width.

They are tilted along the longitudinal direction, so as to form an acute angle, designated as ↵ in FIG. 6, relatively to the axis X-X'. As an indication, this angle ↵ has a value of the order of 30°.

The central ring 5*a* defines a cylindrical channel 8, with an axis X-X', allowing free passage of the gases.

The spaces between the vanes 6 define an annular peripheral passage path 9 for the gases.

Figure 7:
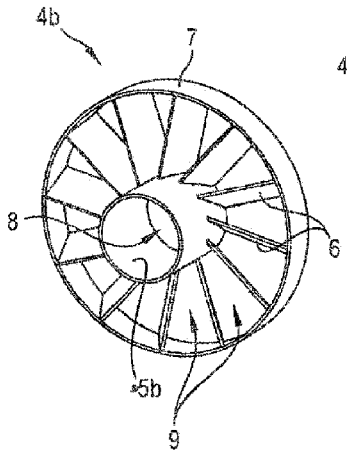
FIGS. 7 and 8 illustrate a second possible embodiment of the stabilizing device of the invention, these views being respectively similar to FIGS. 4 and 6 of the first embodiment.
Figure 8:
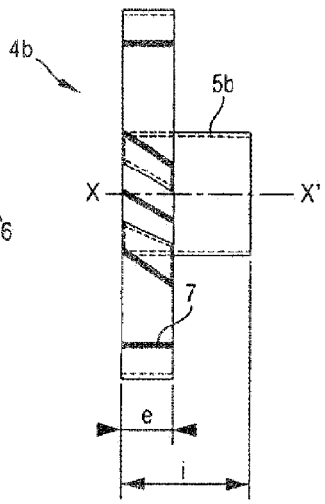

The device, object of the second embodiment, illustrated in FIGS. 7 and 8, consists in a grid 4*b* which differs from the grid 4*a* which has just been described, only by the fact that the length i of its central sleeve, referenced as 5*b*, is notably greater than the axial dimension e common to the vanes 6 and to the outer ring 7. As this will be seen later on, with reference to FIG. 13, the portion of this sleeve 5*b* which juts out from the general plane of the grid is intended to penetrate inside the burner.

Figure 9:
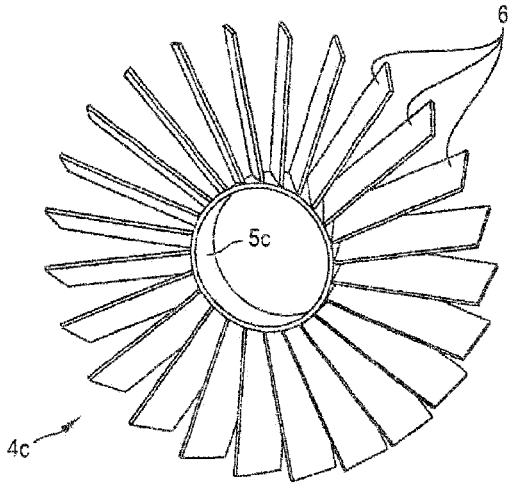
FIG. 9 illustrates a third possible embodiment of the stabilizing device of the invention, this view being similar to FIG. 4 of the first embodiment.

The device, object of the third embodiment illustrated in FIG. 9, consists in a grid 4*c* which differs from the grid 4*a* by the fact that it does not include any outer ring.

The vanes 6 are intended to be positioned and directly applied against the cylindrical inner face of the inlet opening of the burner. These varies therefore have a length such that their outer edge is inscribed in a cylindrical (fictitious) envelope, the diameter of which corresponds to that of this inner face.

Moreover it will be noted that the number of vanes 6 is twice that of the previous devices, since it is 24, therefore distributed with 15° angular intervals.

Figure 1:
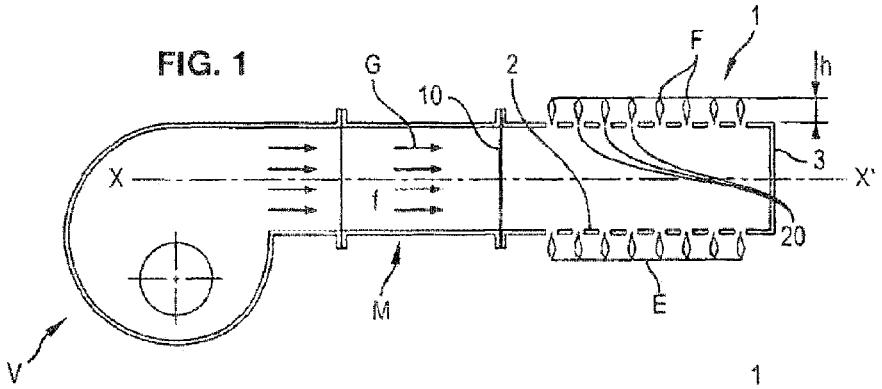
FIGS. 1-3 depict embodiments of surface combustion gas burners.
Figure 10:
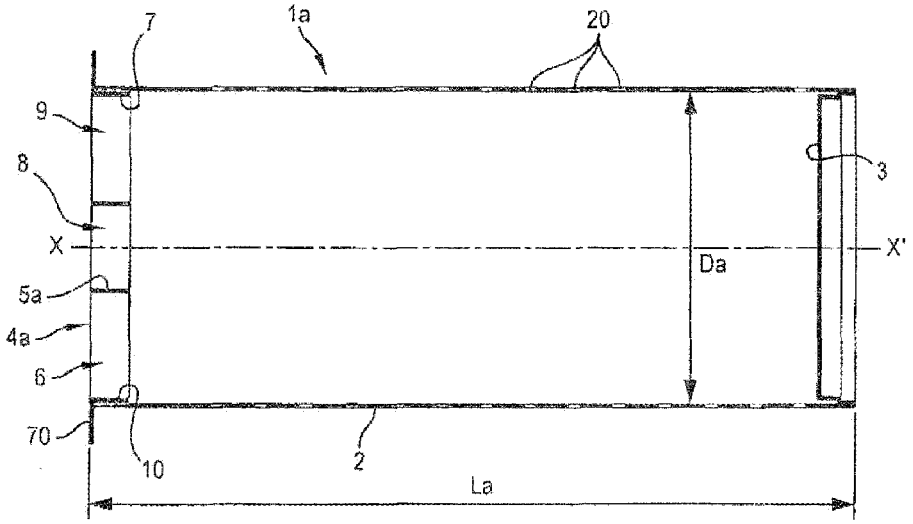
FIG. 10 is an axial section of a burner provided with a stabilizing device according to the first embodiment.

The burner 1*a* illustrated in FIG. 10 is of the same type as the one described earlier with reference to FIGS. 1-3.

A stabilizing device 4*b* according to the first embodiment described above, is axially fitted into the inlet opening 10 of the burner and is retained therein, for example under the effect of simple friction due to some tightening between the outer face of the ring 7 and the inner face of the mouth of the cylindrical wall 2.

Advantageously, the ring 10 is provided with a flange 70 forming a stop abutment, which limits its sinking into the inside of the burner body.

Figure 11:
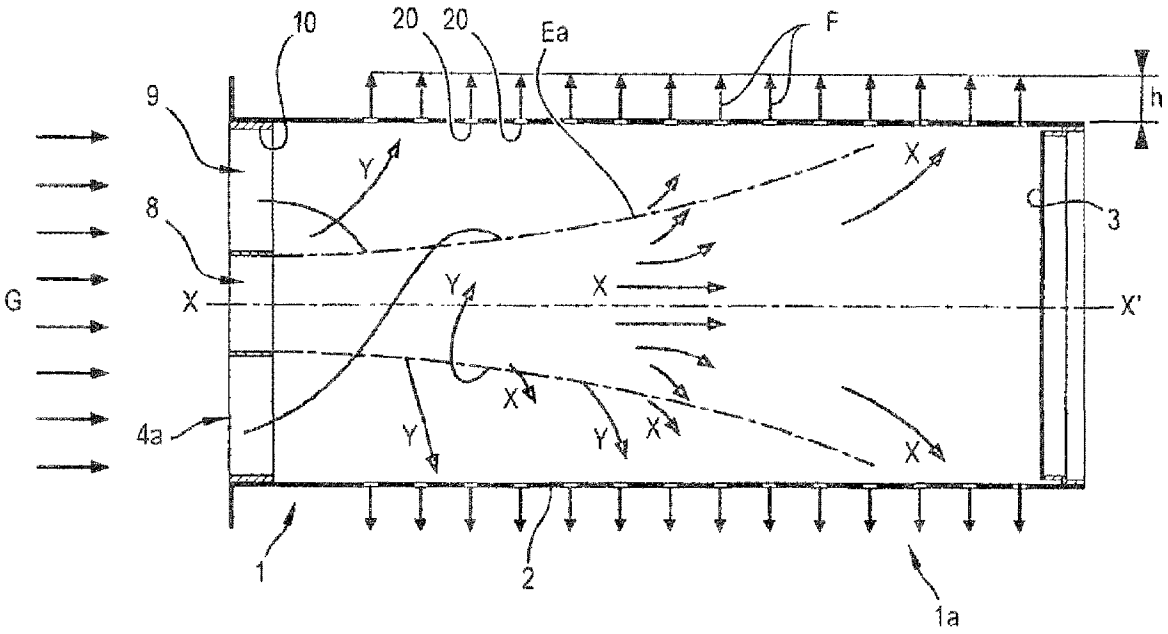
FIG. 11 is a view analogous to FIG. 10, intended to illustrate the operation of the device by showing how the distribution of the gas flows is accomplished inside the burner.
Figure 12:
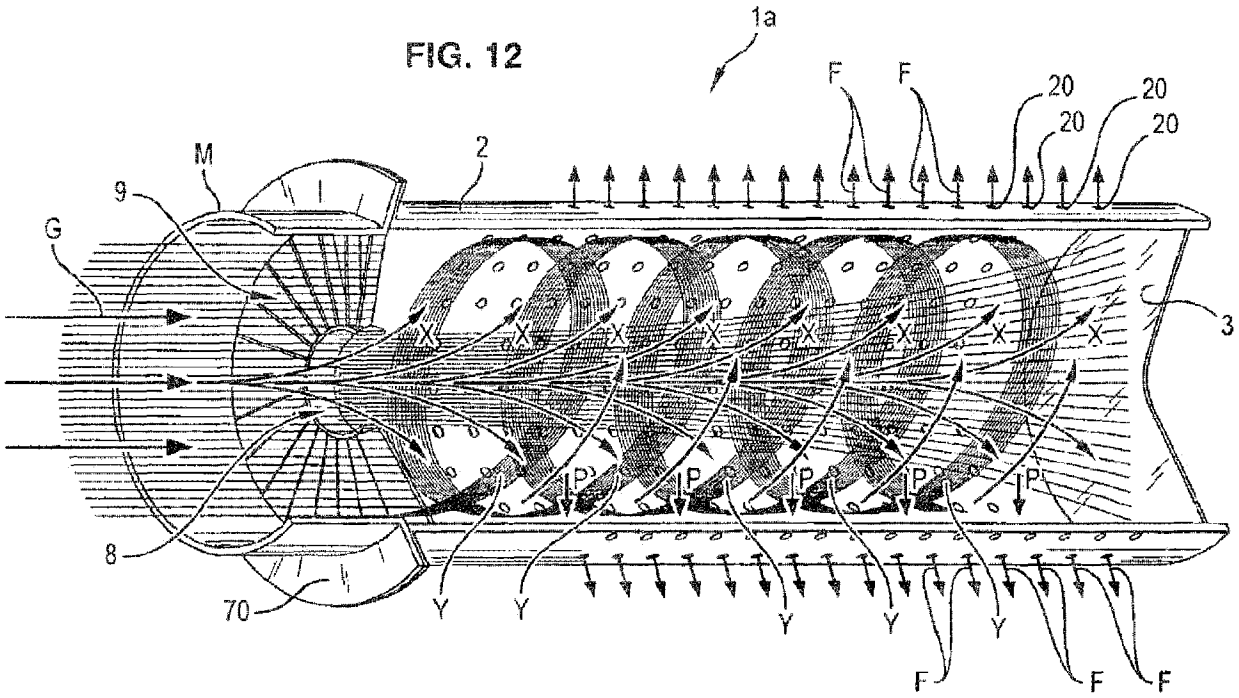
FIG. 12 is a perspective and sectional view similar to FIG. 11.

FIGS. 11 and 12 illustrate the action mode of the device.

The gas flow G driven back by the fan and arriving at the inlet of the burner 1*a*, has to cross the grid of the stabilizer 4*a*.

It is then subdivided into two distinct flow portions, i.e. a central portion which crosses the channel 8 delimited by the central ring 5*a*, and an outer portion which crosses the formed space 9 located between the vanes 6.

In FIG. 11, the dashed line illustrates the fictitious envelope Ea which separates both of these portions.

The central flow, symbolized by the arrows X, is a regular or even laminar flow, with a trajectory globally in translation along X-X', towards the bottom 3. However, the mass of gas tends to flare out, as a cone and then "as a trumpet", as shown by the contour of the envelope Ea.

The outer flow, symbolized by the arrows Y, follows a helical vortex trajectory at high speed around the central flow, this trajectory combining an axial translational movement and a rotational movement (twist) which is imparted to it by the tilt of the diverting vanes 6.

The external flow surrounds the central flow on almost all its length (upstream side).

Relatively surprisingly, the combination of both of these flows ensures regular distribution of the flow rate and of the pressure of the gas inside the burner over the whole of its length and over the whole of its periphery (over 360°).

In practice, it appears that the combustion orifices 20 of the upstream portion of the burner (on the side of the inlet opening 10) are essentially supplied with gas provided by the external vortex flow while on the contrary the combustion orifices of the downstream end portion of the burner (close to the bottom 3) are essentially supplied with gas provided by the non-perturbed central flow.

Gradually as one moves from upstream to downstream, the amount of gas from the external flow decreases, while the one from the central flow increases, the sum of both amounts remaining substantially constant. The cyclonic movement internal to the burner further promotes good distribution of the flow rate and pressure so that finally a flame height F is obtained with constant height over the whole combustion surface.

Figure 2:
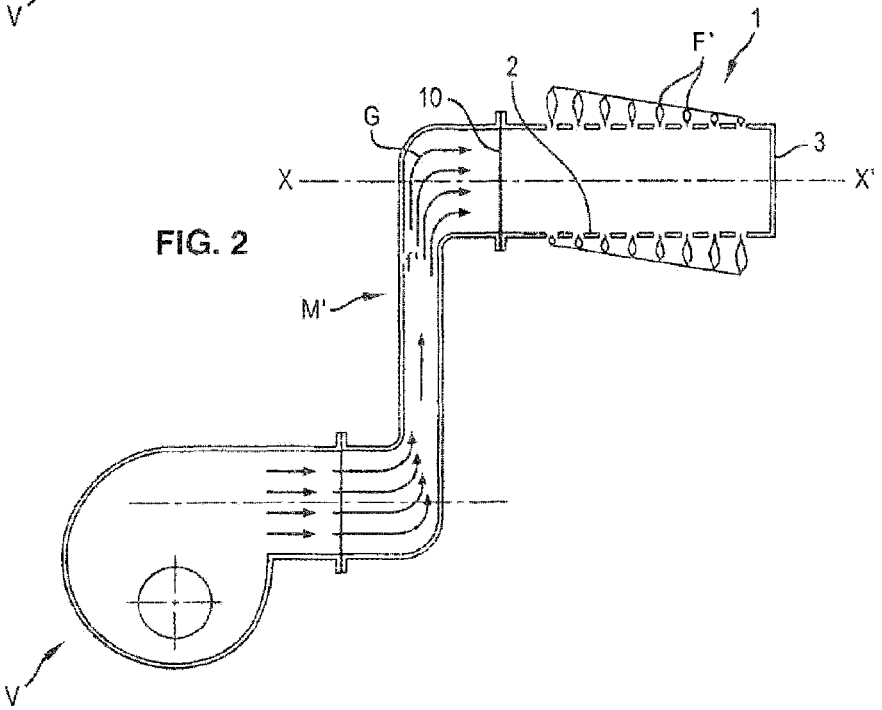
Figure 3:
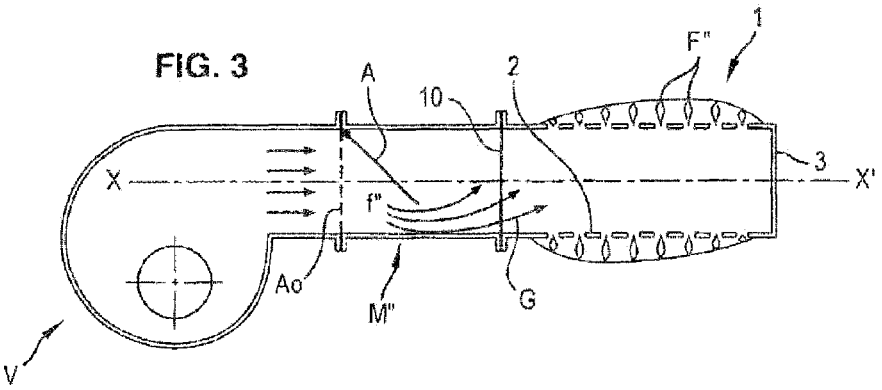

This remarkable result is obtained even when the gas flow which arrives at the burner is deviated and/or inclined, notably as a result of the presence upstream from the latter of a bent sleeve of the kind illustrated in FIG. 2, of a valve of the kind illustrated in FIG. 3, or of a valve for adjusting the flow rate provided to the burner.

The pressure loss resulting from the presence of the device at the inlet of the burner is negligible.

The dimensions of the stabilizing device should naturally be adapted to the structure and to the dimensions of the burner.

As an indication, the burner 1*a* which has just been described has a perforated wall 2 in stainless steel metal sheet, the thickness of which is 0.3 mm.

The punching rate of the wall (ratio of the area of the perforations and of the total area of the perforated wall) is of the order of 30%.

Its length and its inner diameter respectively designated as La and Da in FIG. 10, are 160 mm and 70 mm respectively.

The stabilizing device 4*a* may also be made in thin stainless steel metal sheet.

The external ring 7 has a diameter of 70 mm with a functional tolerance allowing it to be fitted without any clearance, or even with some tightening, in the inlet opening of the burner.

The central ring 5*a* has a diameter of 24 mm.

The axial dimension e of the device is 10 mm.

Figure 13:
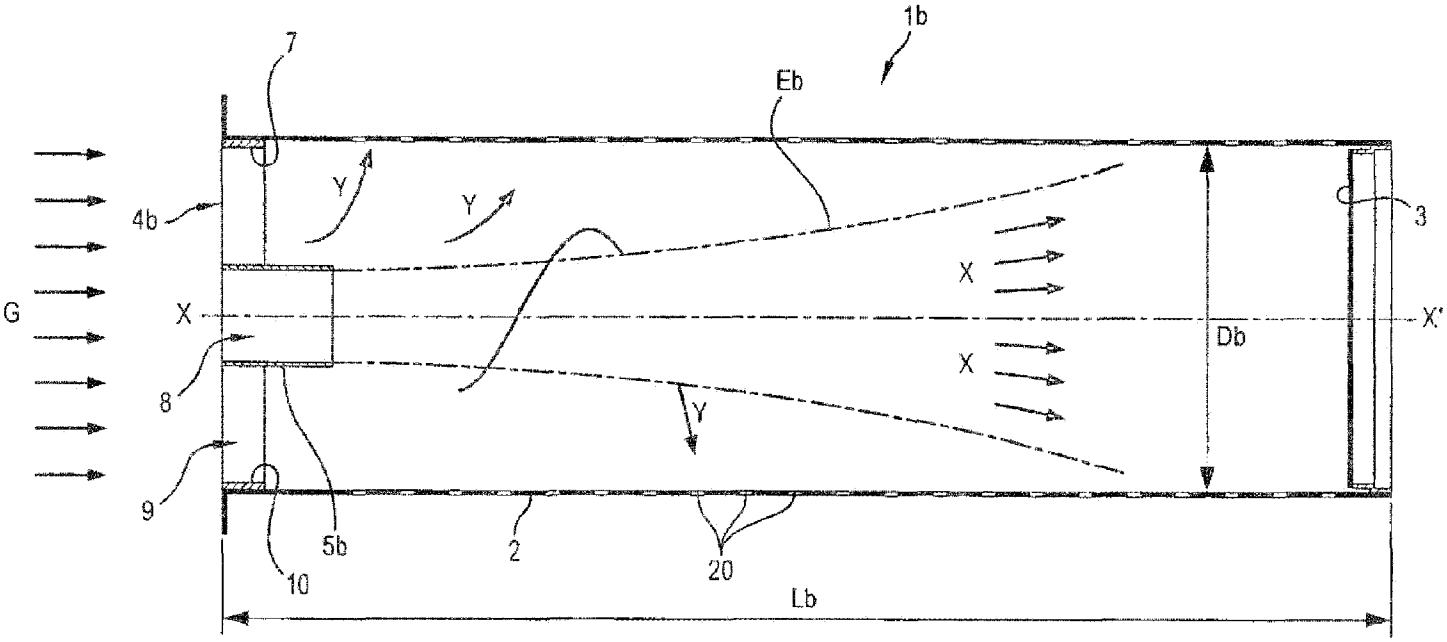
FIG. 13 is a view analogous to FIG. 11, but with a burner of greater length, provided with a stabilizing device according to the second embodiment.

The burner 1*b* illustrated in FIG. 13 is similar to the burner 1*a* except for its length Lb which is greater.

As an indication, Lb=240 mm.

Its diameter Db=70 mm.

As already stated, the stabilizing device 4*b*, as for it, is identical with the device 4*a*, except for the sleeve forming the central ring 5*b*, the length i of which is substantially greater than e.

As an indication, i=25 mm (while e=10 mm).

As seen in FIG. 13, this sleeve 5*b* has the effect of channeling the central flow so that it diverges less rapidly than the central flow of the first embodiment, so that it may reach the bottom wall 3, further away from the opening as previously.

The envelope Eb which separates the central flow from the outer cyclonic flow flares out more gradually downstream, inside the burner 1*b*, than the envelope Ea inside the burner 1*a*.

The operating mode of both stabilizers is however similar, and generates homogenous distribution of the gas flow rate and pressure, with the result of a regular flame height and optimum combustion hygiene.

In the embodiments described above, the inlet opening 10 of the burner is circular and its diameter is the same as that of the cylindrical perforated Wall.

These characteristics are by no means mandatory.

Further, the stabilizing device may be conformed so as to cap (from the outside) the inlet mouth of the burner instead of being interiorly fitted therein.

The invention claimed is:

1. A cylindrical gas burner comprising:

a perforated cylindrical wall extending between an inlet opening and a bottom wall, wherein the perforated cylindrical wall includes combustion orifices perforating therethrough; and a pressure and flow rate stabilizing device for introducing a combustible gas mixture through the inlet opening, wherein pressure and flow rate stabilizing device caps the inlet opening from outside of said inlet opening or is positioned inside said inlet opening, wherein the pressure and flow rate stabilizing device further comprises:

a central ring surrounded by a series of diverting vanes, wherein the pressure and flow rate stabilizing device allows a central flow of the combustible gas mixture through the central ring, the central flow having a non-perturbed, or not very perturbed, substantially laminar flow, capable of reaching the bottom wall while flaring out gradually, and wherein the diverting vanes are planar lamellas and generate a vortex flow of the combustible gas mixture with an approximately helical trajectory surround the central flow, such that a constant height of a flame is obtained at each combustion orifice.

2. The burner according to claim 1, wherein the central ring is circular, and coaxial with the perforated cylindrical wall of the gas burner.

3. The burner according to claim 1, wherein said vanes extend radially relatively to the longitudinal axis of the perforated cylindrical wall with a regular angular distribution.

4. The burner according to claim 3, wherein the number of vanes is comprised between 6and 30.

5. The burner according to claim 3, wherein said vanes are all identical and with constant width, which are tilted in a longitudinal direction of the gas burner, their plane forming an acute angle relatively to the longitudinal axis of the perforated cylindrical wall of the gas burner.

6. The burner according to claim 5, wherein said angle has a value comprised between 15 and 45°.

7. The burner according to claim 1, wherein said vanes are integral with the central ring.

8. The burner according to claim 1, wherein the pressure and flow rate stabilizing device further comprises:

an outer circular ring, the vanes of which are integral therewith, capable of being fitted and immobilized into the inlet opening of the burner.

9. The burner according to claim 1, wherein the central ring is a sleeve, the length of which is substantially equal to the axial dimension of the vanes.

10. The burner according to claim 1, wherein the central ring is a sleeve, the length of which is greater than the axial dimension of the vanes.

11. A method for stabilizing the pressure and flow rate of a combustible gas mixture being feed to a cylindrical gas burner through an inlet opening thereof, the gas burner including a cylindrical wall extending between the inlet opening and a bottom wall, the cylindrical wall having combustion orifices perforating therethrough, the method comprising:

dividing the gas mixture penetrating the burner through the inlet opening into two distinct flows, a central flow with non-perturbed, or not very perturbed flow, substantially laminar, capable of reaching said bottom wall while flaring out gradually, and a vortex flow with an approximately helical trajectory surrounding the central flow, such that a constant height of a flame is obtained at each combustion orifice.

12. The burner according to claim 4, wherein the number of vanes is comprised between 11 and 25.

13. The burner according to claim 6, wherein said angle has a value of 30°.

* * * * *